US006817472B1

(12) United States Patent
Williams

(10) Patent No.: US 6,817,472 B1
(45) Date of Patent: Nov. 16, 2004

(54) PACKAGING COMPONENT AND CONTAINMENT SYSTEM PARTICULARLY USEFUL FOR PACKAGING RADIATORS

(75) Inventor: Richard E. Williams, Lindenhurst, IL (US)

(73) Assignee: Cougar Package Designers, Inc., West Chicago, IL (US)

( * ) Notice: Subject to any disclaimer, the term of this patent is extended or adjusted under 35 U.S.C. 154(b) by 0 days.

(21) Appl. No.: 09/576,499

(22) Filed: May 23, 2000

Related U.S. Application Data

(60) Provisional application No. 60/135,471, filed on May 24, 1999.

(51) Int. Cl.[7] ..... B65D 73/00

(52) U.S. Cl. ..... 206/495; 206/335; 206/521

(58) Field of Search ..... 206/335, 521, 206/591, 594, 592, 597, 495

(56) References Cited

U.S. PATENT DOCUMENTS 1,827,334 A 10/1931 Rider
2,917,165 A * 12/1959 Cadillac et al. ..... 206/335
3,221,872 A * 12/1965 Wood ..... 206/305
4,759,446 A * 7/1988 Dobashi et al. ..... 206/586
4,792,043 A * 12/1988 Holladay ..... 206/349
4,865,200 A * 9/1989 Sullivan et al. ..... 206/583
5,285,901 A 2/1994 Huang ..... 206/521
5,678,695 A * 10/1997 Ridgeway et al. ..... 206/583
5,823,352 A * 10/1998 Mena et al. ..... 206/721

* cited by examiner

*Primary Examiner*—Anthony D. Stashick
*Assistant Examiner*—Troy Arnold
(74) *Attorney, Agent, or Firm*—Baniak Pine & Gannon

(57) ABSTRACT

A packaging component and packaging system are disclosed. In an embodiment specifically adapted as a system for packaging vehicular radiators, the invention provides a generally planar tray member component as a blank having two opposed sides, with a portion of each opposed side being foldable out of the plane of the tray member to yield arms to the tray. Strapping is supplied which is engageable with the arms when the arms are folded upon the radiator placed upon the tray member. Opposed ends for the tray member have a portion which is likewise foldable out of the plane of the tray member, yielding legs to the tray when so folded. The packaging system can include at least one stand-off element mountable on one of the radiator and the tray member operating as a spacer and positioner relative to a container within which the tray member is received with the stand-off element mounted in place.

7 Claims, 4 Drawing Sheets

PACKAGING COMPONENT AND CONTAINMENT SYSTEM PARTICULARLY USEFUL FOR PACKAGING RADIATORS

This application claims the benefit of Provisional application Ser. No. 60/135,471, filed May 24, 1999.

FIELD OF THE INVENTION

This invention relates to what is commonly referred to as "protective packaging", and more specifically to such devices and components utilized in protecting heavy goods which may also have fragile parts to be handled or shipped, and the materials utilized to fabricate such devices and components.

BACKGROUND OF THE INVENTION

A packaging component may be generally defined as a material or plurality of materials that are selected and designed for the purpose of providing specific packaging properties or a range of properties. These materials are used in such a manner so as to construct or fabricate packaging components. Examples of some packaging materials would be paper, corrugated paper, fiber board, polyurethane foam and boards, expanded polystyrene, polyethylene, polypropylene, steel, aluminum, wood, and virtually any other material deemed appropriate for the packaging challenge at hand.

A packaging component may best be described as an engineered device that communicates with the object actually being packaged in such a manner so as to provide for the optimum level of packaging protection achievable. Examples of packaging components would be a plastic bag, a corrugated carton, a wood or paper pallet, a corrugated slip sheet, an aluminum can, an expanded polystyrene corner, a "foam in place" construct made of polyurethane foam, and plastic bubble wrap, just to name a few. Obviously, the aforementioned list is far from being comprehensive. More specifically, for the purposes of this disclosure, the terms "packaging", "protection", and "cushioning" shall refer to all of the processes and factors relevant to ensuring the safety of an item or items during the "material handling" process. Additionally, for the purposes of this disclosure, the term "material handling" shall refer to all of the factors relevant to the staging, organization, storing, location, loading, movement, shipping, unloading, wrapping, containment, tracking, protection, and overall "safety and preservation" of goods and materials.

As illustrated above, a multitude of various packaging materials exists today, the variety of which are almost unlimited. Even more staggering is the number of packaging components constructed of these materials. The criteria for determining the selection of materials and the subsequent design of the packaging component are usually performance and economy. Virtually any packaging challenge can be addressed effectively when only performance parameters are considered. When economic factors are taken into account, however, the task can become quite challenging.

A formidable task with respect to the instant invention was to provide a packaging system that could successfully protect from damage the delicate features generally indigenous to all vehicular radiators. While the invention hereafter described is particularly directed to this application of packaging such radiators, it will be understood that the invention has far broader application in other environments and to other articles to be packaged.

Generally stated, all radiators, whether designed for the smallest sub-compact car or the largest diesel off road truck, present numerous packaging challenges. For example, all such radiators have as a main component a tank or plurality of tanks the purpose of which are to contain cooling fluids. These tanks are generally delicate (e.g., thin-walled), often irregularly shaped, and may possess thin and/or sharp surfaces. Additionally, the tanks may typically be made of either plastic, copper-brass, or aluminum. Those radiators that are constructed of copper-brass are particularly difficult to protect and package given their weight, because the stresses placed on the packaging are significantly higher due to higher inertial forces. The packaging of the prior art therefore necessitated the utilization of a different design than that which would be employed for the plastic or aluminum radiator, for instance.

Generally speaking, radiators can be classified into three general categories of construction. For the purposes of this disclosure, they are referred to as follows:

Category "A": Radiators are constructed of plastic tanks, aluminum frames, and aluminum cores. Radiators in this category are the lightest, and hence easiest to package.

Category "B": Radiators are constructed of plastic tanks, copper-brass frames, and aluminum cores. Radiators in this category are somewhat more difficult to package than those of category "A" above.

Category "C": Radiators in this category are constructed of copper-brass tanks, copper-brass frames, and aluminum cores. Radiators in this category are by far more difficult to package than those of categories "A" and "B". Therefore, the prior art methodology for packaging radiators in this category includes the use of certain packaging materials that one would typically not employ when packaging radiators of categories "A" and "B". Specifically, the radiators of category "C" are packaged utilizing polyurethane based "foam-in-place" and molded "EPS" (expanded polystyrene). Although both of these materials provide adequate protection and thus good packaging attributes, both of these materials are considered less than ecologically sound.

Other characteristics of radiators are delicate, protruding valves, a filler neck, hose fittings, and other miscellaneous protrusions that facilitate connection with the intended machinery. All radiators have as one of their main components, what is known as a "cross-flow" or "down-flow" section. The respective terms refer to the arrangement of the tank(s) with regard to the final orientation of the radiator. The core section is typically comprised of many, very delicate cooling fins. Due to the fragile nature of the fins, extra attention to the design of the packaging is called for.

There have been numerous prior art attempts to meet the demands of packaging such articles. The would-be solutions and components available, however, are either not entirely satisfactory as performers mechanically, they do not meet the requisite costs constraints, or they simply do not provide an adequate performance to costs benefit.

To further complicate matters, another challenge presented was to provide a package that would, in effect yield a universal packaging design for virtually all radiators, regardless of size and weight. To clearly illustrate the formidable task at hand, one need only consider the scope and diversity of machinery that has as part of its mechanical constitution, at lease one radiator. One company is known to manufacture at least 200 different radiators, for cars and light trucks alone, hence, the range and scope of radiator designs is staggering. Currently, packaging for radiators tends to be highly specific; that is, each different style and specification of radiator has had its packaging designed specifically for it. Stated differently, a package designed for radiator "x" would fit radiator "x", and possibly some other radiators, but this limited adaptability would be a function of chance, not necessarily intelligent design. Obviously, the sheer quantity of packaging that one company would need to stock in order to have packaging on hand for 200 radiators is colossal. Additionally one must consider the logistical challenge of tracking and handling the huge inventory, and designing a new package as required for each new radiator design.

Another factor that must be considered is the life cycle of the tools required on producing the packaging components. Because of the very limited applicability of the prior art packaging to a range of radiators, a tool designed, for example, to form expanded polystyrene end caps for a given range of radiator designs becomes less universal each year in its applicability, and thus, has less remaining value.

It becomes clear that the currently available packaging and approaches to packaging provide a relatively expensive attempt to resolving the problem of packaging radiators.

Specifically, it is most desirable to provide a packaging solution that is more universal in its application. Stated more precisely, a highly desirable radiator package design would be one that provides exceptional protection, is convenient to ship and handle, is environmentally friendly as well as economically feasible, and provides one package of a given specification capable of packaging a range of radiator designs. While it is possible for some of the prior art designs to meet some of the cushioning-protection (mechanical) requirements, to this Applicant's knowledge, there are no packages available that meet all of the desired characteristics. Thus, all packaging components for cushioning and protecting radiators heretofore known suffer from a number of disadvantages:

(a) They fail to provide a support mechanism which will properly cushion and protect the product, and (b) are not universal in applicability across a range of radiators.

(c) Their utilization requires the investment in large inventories of packaging components because, (d) it is required that each new package be more or less custom designed, thus, (e) there are design/engineering cost(s) inherent in each container which results in (f) a more costly overall packaging solution when all economic factors are considered.

SUMMARY OF THE INVENTION

It is a principal objective of the present invention to provide a new and improved component for packaging an article, and a packaging system using that component. It is a more specific objective to provide a packaging system for a vehicular radiator with such a new and improved packaging component.

To these and other ends the present invention has a base member with a central part defining a plane and a first pair of opposed sides. A portion of each opposed side of the first pair of sides is foldable out of the plane of the base member to form arms to the base, with the arms being connected to the central part.

There is a member, such as one or more straps, engageable with the arms when they are folded toward each other, such as when the arms are embracing an article on the base. The article to be packaged with the arms in the folded condition and the strap(s) engaged with the arms is thereby stabilized relative to the base member.

The packaging component further advantageously includes a second pair of opposed sides on the base member. This second pair of opposed sides is orthogonal to the first pair of sides, with a portion of each opposed side of the second pair being foldable out of the plane of the base member, and forming legs when so folded.

In one preferred form of the invention, the base member is made of a rectangular planar sheet, such as of a rigid Kraft paper, and is cut, as by die-cutting, to form the arms. The legs are defined, at least in part, by fold lines on the sheet. Also, by way of explanation and not limitation, when regions or demarcations are described as being "cut", this could and is meant to include not only complete slits but also perforations which may not be completely cut through in all respects, but are readily split to form complete cuts. "Fold lines" likewise can be defined by perforations, embossments, weakened areas and the like.

The packaging component of the foregoing preferred form has a center line, with parallel lateral sides and parallel ends to the sheet. The legs are defined by a first fold line inboard from and parallel to an adjacent lateral side, and a second fold line inboard from and parallel to an adjacent end. In one embodiment, the legs are further defined by a diagonal fold line extending diagonally inboard from each corner of the rectangular planar sheet, which forms a gusset (or bellows) when the legs are folded.

In another embodiment, instead of a bellows corner, the legs are further defined by side leg portions and end leg portions, with a cut forming a lapping portion at each corner of the rectangular planar sheet. The lapping portion is folded over and overlies an adjacent leg portion when the legs are folded. Most advantageously, the legs further include pre-cut locking tabs formed in one of the side and end leg portions at each corner of the sheet. Pre-cut tab receptacles are formed in the other of the side and end leg portions, again at each corner. The pre-cut tabs and tab receptacles are located so that the tabs can be received within the receptacles when the legs are folded. This eliminates the need to glue or otherwise affix the legs in position.

The packaging component of one preferred embodiment has each arm defined by a pair of spaced cuts extending inboard from a respective side. There are a plurality of fold lines extending between the spaced cuts. This yields arms which can readily be folded, at one of numerous fold lines, about articles (e.g., radiators) of different dimensions.

In an embodiment specifically adapted as a system for packaging vehicular radiators, the invention provides a generally planar tray member having two opposed sides, with a portion of each opposed side being foldable out of the plane of the tray member to yield the foregoing arms to the tray. Strapping is supplied which is engageable with the arms when the arms are folded upon the radiator placed upon the tray member. This embodiment further includes opposed ends for the tray member, with a portion of each opposed end likewise being foldable out of the plane of the tray member, yielding the foregoing legs to the tray when so folded.

At least one stand-off element mountable on one of the radiator and the tray member can be advantageously provided. The stand-off element operates as a spacer and positioner relative to a container within which the tray member is received with the stand-off element mounted in place.

The foregoing embodiment for the packaging system also has the noted container within which the tray member with radiator attached thereto is received. The container is preferably sized to snugly fit around the tray member.

Accordingly, several objects and advantages that the present invention accomplishes are: providing a support mechanism which will protect the product, and is universal in applicability across a range of articles, such as radiators. The utilization of the invention does not require the investment in large inventories of packaging components because it is not required that each package be custom designed. Hence, there are no design/engineering cost(s) inherent in each new container, and thus a cost effective overall packaging solution is provided, especially when all economic factors are considered.

Other objects and advantages achieved in the present packaging component and system will become more apparent and be further understood from a consideration of the following detailed description of embodiments of the invention taken in conjunction with the drawings, in which:

DETAILED DESCRIPTION OF EMBODIMENTS OF THE INVENTION

In accordance with the present invention, the unique, highly adaptable containment system is described in a particular application for packaging vehicular radiators. In broad overview, one embodiment of the system has components comprising a die-cut tray of medium to heavy weight AB Kraft paper. A bellows (gusseted) corner is provided for the legs, which are folded away from the side upon which the radiator is located to thereby yield an upraised platform for packaging within a carton. The arms used to embrace the radiator are slit-scored adjustable "bands". A separate tube of Kraft fiberboard, or a honeycomb block, is used which functions as a stand-off/spacer. Additionally, one or more adjustable polyester straps are utilized to tie the arms in place. In another embodiment, the legs have two portions which overlap in the corners, with an interlocking tab/receptacle arrangement punched in the Kraft paper to hold the legs in folded position.

Figure 1:
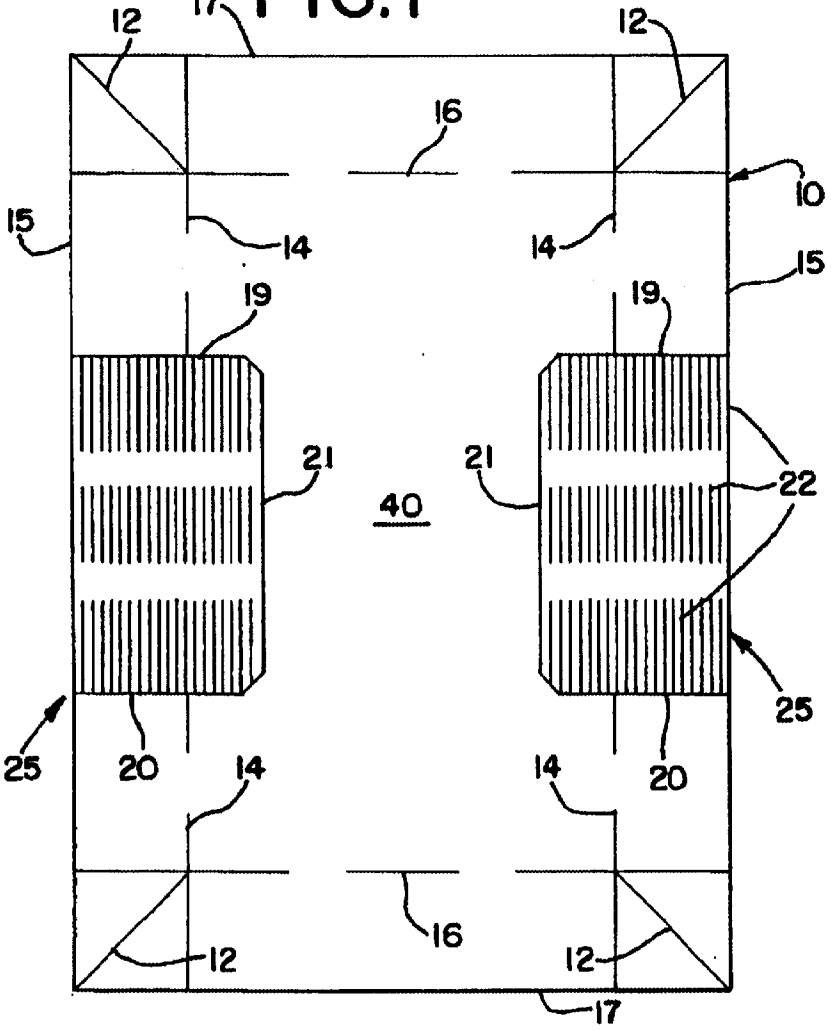
FIG. 1 is a plan view of a sheet for a packaging component made in accordance with the present invention.

Turning now to the drawings, FIG. 1 shows a sheet of the foregoing Kraft paper 10 which has been die-cut, perforated, scored and provided with fold lines as will be hereinafter described. Of course, although the present invention has been formed using Kraft paper, other rigid materials capable of holding shape under the size and weight to be stabilized/supported can readily be used.

The die-cut tray herein is of medium to heavy weight (AB 350 to AB 450) Kraft, and has bellows corners in the form of gussets yielded by diagonal fold lines 12 in the four corners of the sheet 10. Scoring is provided along lines 14, which are spaced inboard and parallel to lateral sheet sides 15. Scoring is also provided along lines 16 which run parallel to respective sheet ends 17. It should be noted that "sides" and "ends" as used herein should not be considered specifically limiting, but are rather used for ease in orientation, since ends and sides are relative terms as applied to the sheet material.

A pair of spaced apart cuts 19, 20 extend inboard from each side 15, terminating in a fold line 21. A plurality of incompletely perforated parallel lines 22 extend between the cuts 19, 20. These parallel weakened lines 22 with the cuts 19, 20, yield arms 25 that are readily folded to embrace articles, such as radiators, of various sizes and shapes, as will be hereinafter described. The arms 25 so formed are adjustable, and thus provide a relatively high degree of adaptability to radiators 30 of varying size. More precisely, the die-cut perforations 22 are engineered so that the desired quantity of material to be folded over the radiator 30 is easily released from its original position, and folded over the radiator.

It will be understood that the relative geometrical disposition of the various features defined by the sheet 10 is considered one of the major aspects of this invention. Stated more precisely, the particular tray that results from the specific arrangement of elements of the sheet 10 is but one conceptualization of the myriad trays that may result from the FIG. 1 sheet 10, which is quintessentially indicative of the ability to resize and/or reposition the various features of the tray. This provides one of the means of adapting the tray to a range of radiators. It is an objective accomplished by this invention that this tray is engineered to easily accommodate radiators of light or heavy weight, merely by using AB Kraft of lighter or heavier construction. Further, it is an additional accomplishment of this invention that this tray is engineered to easily accommodate radiators of various dimensions simply by scaling the tray up or down, and/or forming arms/legs variously along sides/ends.

Figure 2:
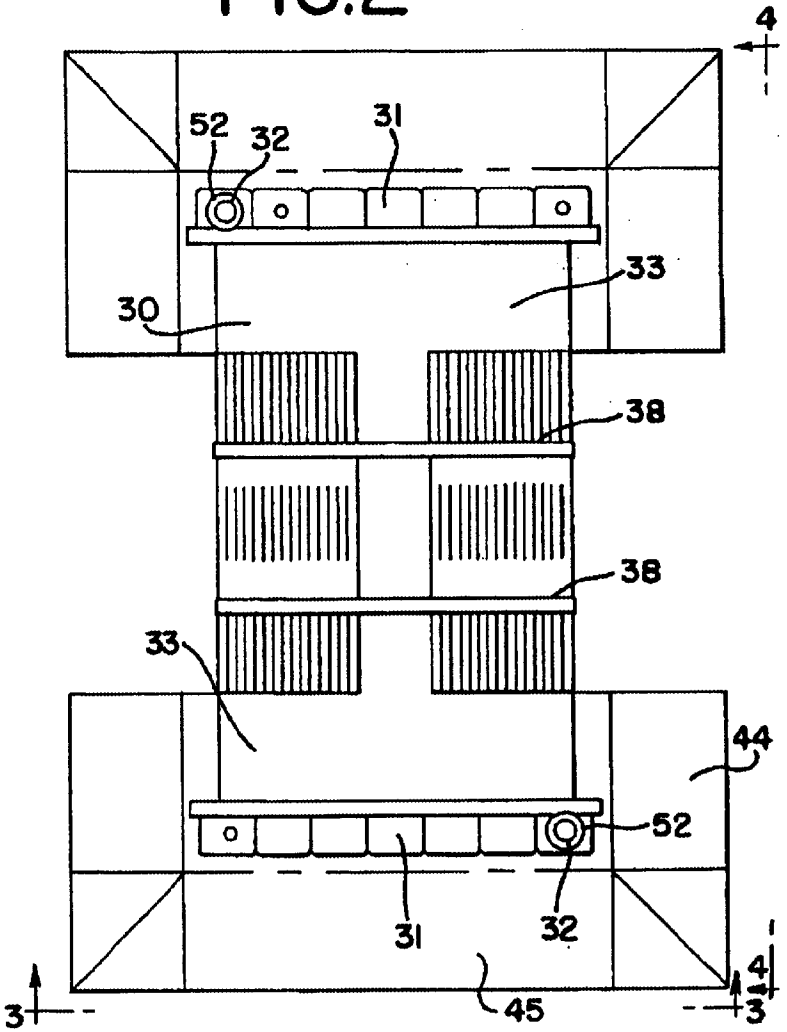
FIG. 2 is a an enlarged view of the sheet of FIG. 1 with a radiator positioned thereon and the arms folded and strapped in place.

FIG. 2 depicts a very generalized radiator 30. The tank(s) of the radiator are shown at 31, and connectors that facilitate attachment of the radiator to hoses are shown at 32. Delicate fins for the radiator would generally comprise much of the area at 33.

Figure 3:
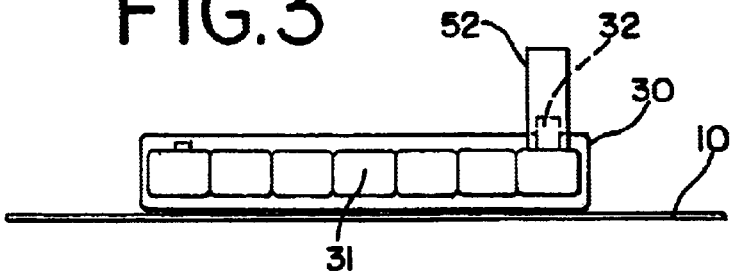
FIG. 3 is an end view taken along line 3-3 of FIG. 2.
Figure 4:
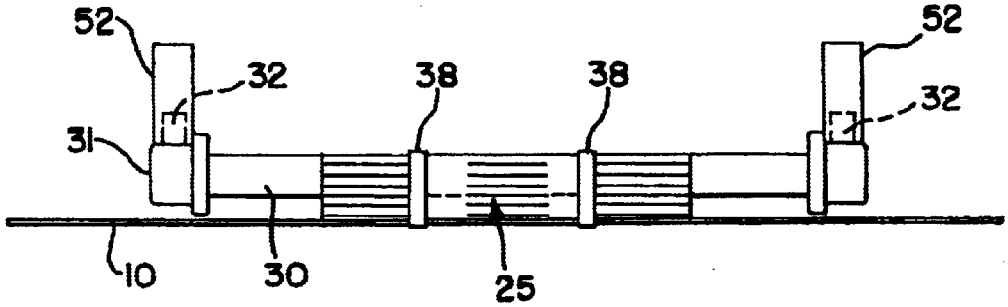
FIG. 4 is a side view taken along line 4-4 of FIG. 2.

Referring to FIGS. 2 through 4, members for engaging the arms 25 in the form of straps 38 are shown. In the typical embodiment, the strap 38 is comprised of any commonly available strapping material of sufficient strength to ensure that the radiator 30 is securely fastened to the tray. In the preferred embodiment, the strap 38 is composed of polyethylene, thus providing a means of reducing scuffing of the radiator surface.

Figure 5:
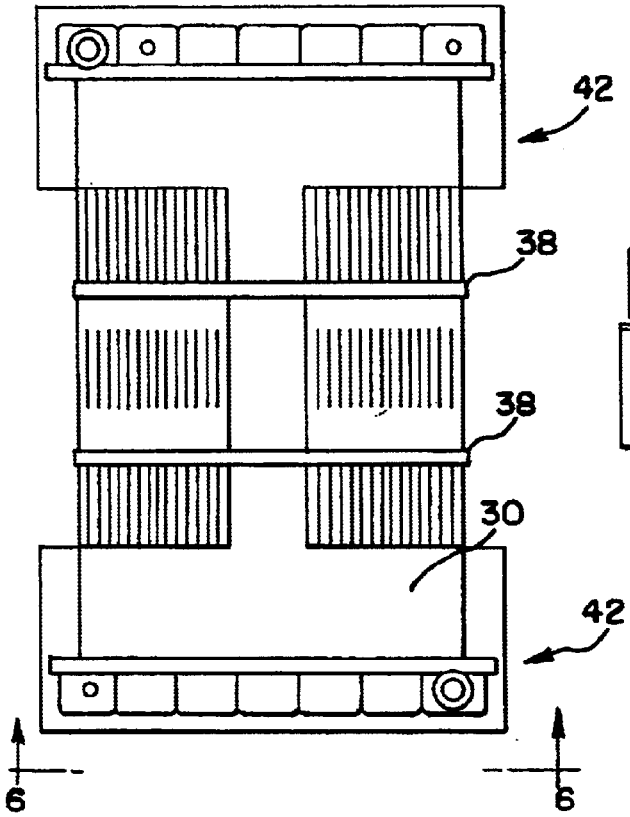
FIG. 5 is a view similar to that of FIG. 2 showing the component with the end portions folded.
Figure 6:
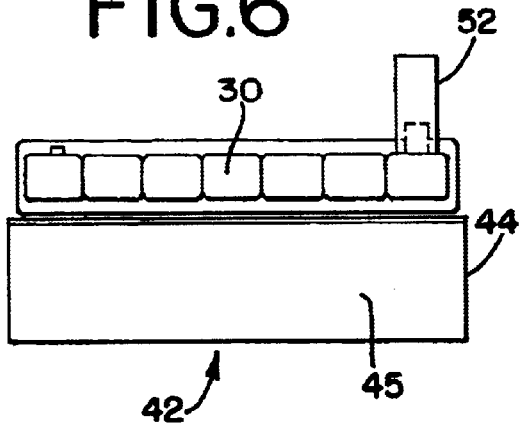
FIG. 6 is an end view taken along line 6-6 of FIG. 5.

Now referring to FIGS. 5 and 6, there is illustrated the tray component of the present invention with legs 42 having been folded from the ends of the sheet 10. Perforations 14, 16 have been placed (FIG. 2) upon each of the two longitudinal ends via die cutting, and extend into the central part 40 of the sheet 10 in the case of lines 14. Legs 42 are provided in this embodiment by folding along the lines 14, 16, which is facilitated by the diagonal fold lines 12. Here, side leg portions 44 and end leg portions 45 are folded 90° from the central part 40 in a direction away from the radiator 30 mounted on the tray (the tray also being referred to as the base or base member). The central part 40 defines a plane, upon which the radiator is situated. The legs 42 thus formed yield a raised platform for the tray.

Figure 7:
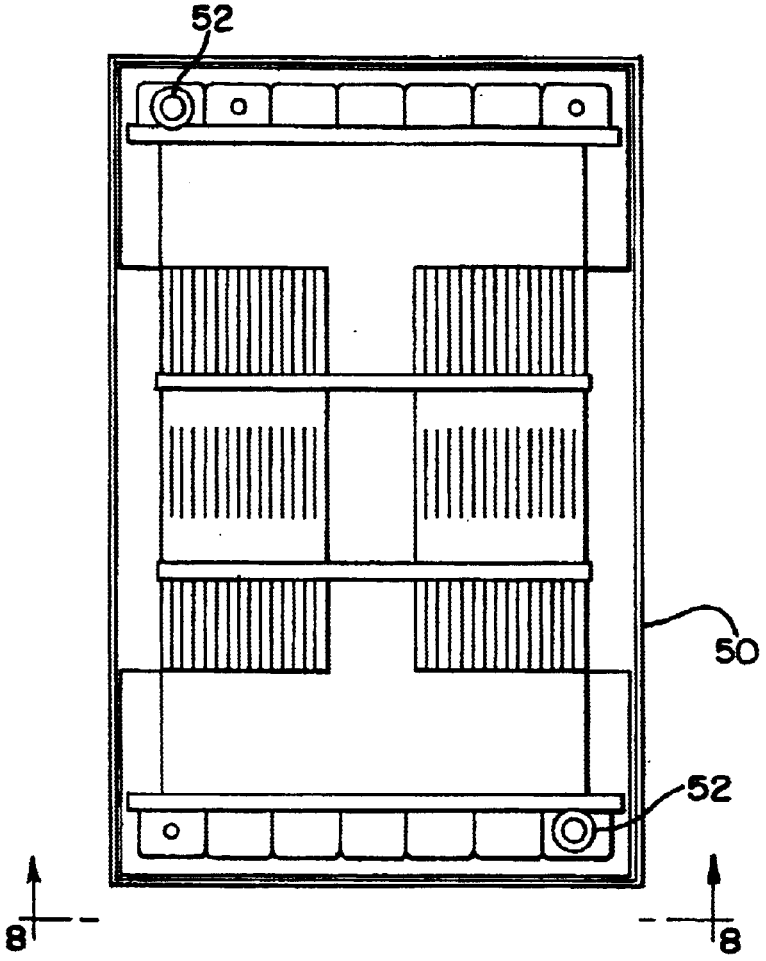
FIG. 7 is a top plan sectional view of the FIG. 5 component with radiator attached thereto positioned within a container.
Figure 8:
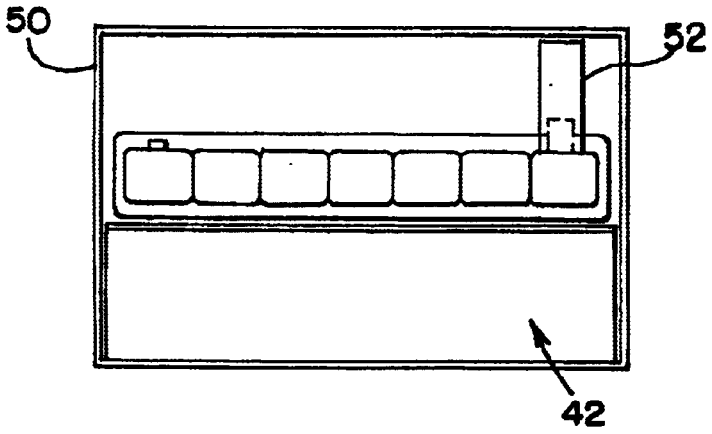
FIG. 8 is an end sectional view (just inside of the container) looking along line 8-8 of FIG. 7.

The tray depicted in FIGS. 5 and 6 is then placed within a container or shipping box 50, as illustrated in FIGS. 7 and 8. Container 50 is most preferably sized to the approximate dimensions of the completely folded (assembled) tray, so that the tray snuggly fits within the box. Of course, packing material might otherwise be provided to fill any void space to securely position the tray with radiator mounted thereto within the box 50.

Also shown communicating with both the radiator 30 and shipping carton 50 are stand-off tubes 52. The tubes 52 are composed of fiberboard which contains a slit originating from one or both of its ends and terminating at some point on the surface of the tube. The length(s), relative disposition, and quantity of slits are determined by the consideration of various engineering criteria during the design-engineering process. Obviously, any combination of material weight, gauge, tube diameter, windings per unit length, number of slits, relative slit disposition, color of material, or other variation thereof is possible with respect to the stand-off tube 52. The tubes 52 are used in this embodiment to span the space between the radiator 30 and the container sidewall over the tray/radiator. This serves to locate the tray/radiator against vertical movement (as one views FIG. 8). While the tube 52 is illustrated mounted over (around) the connector 32, it can be sized to fit within the connector 32, which can have certain advantages.

The legs 42 can simply be folded and the tray/radiator placed within the shipping carton 50, with the carton walls thereby holding the legs 42 in position. The leg portions 44, 45 could otherwise be fixed together, as by gluing, taping or the like.

Figure 9:
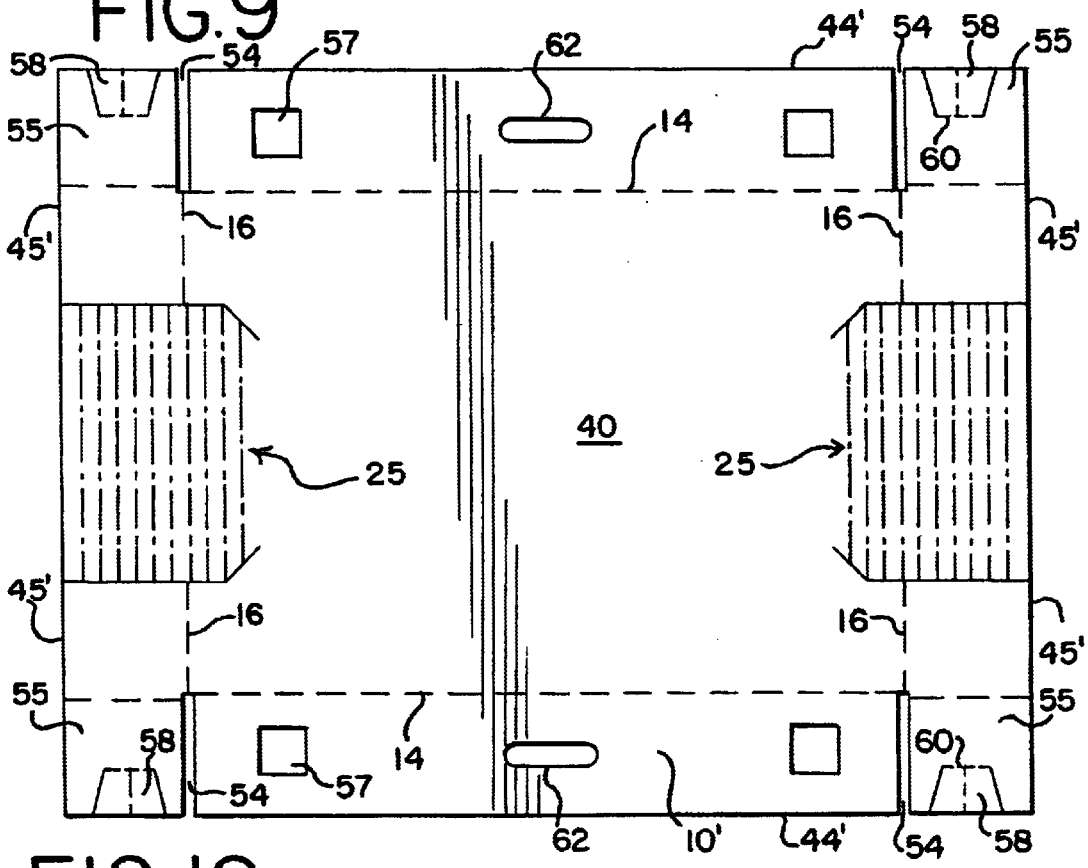
FIG. 9 is a view similar to that of FIG. 1 of another embodiment.
Figure 10:
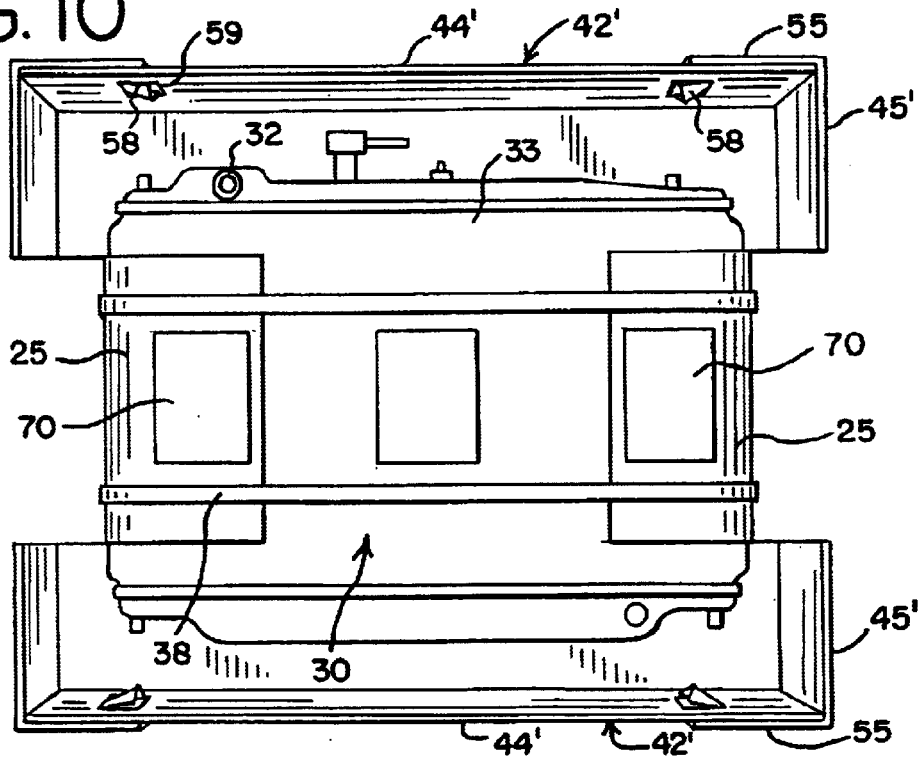
FIG. 10 is a view similar to that of FIG. 5 of the embodiment of FIG. 9.

Referring now to FIGS. 9 and 10, another embodiment is shown (like numbers indicating like elements between embodiments described herein). In this second embodiment, the arms 25 are formed in what might be considered the "ends" of sheet 10'. Ends and sides are, as previously noted, merely relative terms for ease of description. Legs 42' are formed via fold lines 14, 16, and additional cuts 54 in the four corners of the sheet 10'. The cuts 54 yield lapping portions 55, here provided on end leg portions 45' (although lapping portions could alternatively have been provided on adjacent side leg portions 44'). Knock-out parts 57 are formed in side leg portions 44', defining tab receptacles 59. Tabs 58 are formed by scoring/perforations on the lapping portions 55, with the tabs 58 connected to the latter along fold lines 60. Tray handle holes 62 are additionally provided through die-cutting.

The fully-folded tray with legs 42' deployed and locked in position via the tabs 58/receptacles 59 is shown in FIG. 10. The leg portions 44', 45' are folded 90°, and toward the radiator 30 in this embodiment. The lapping portions 55 overlie the adjacent side leg portions 44', with the tabs 58 received within the receptacles 59 to fix the legs 42' in position. The height of the legs 42' thus formed is most advantageously sized to span the distance between the bottom of the shipping container and the container interior sidewall over the tray/radiator.

Spacer blocks 70 are additionally provided. The blocks 70 shown here are made of honeycombed Kraft paper and of a height to generally span the distance between the radiator and the covering container sidewall. The blocks 70 may advantageously be provided in "cookie-cutter" type sheets, with a contact adhesive on one side covered by release paper. In assembly, the blocks 70 are simply removed from the release paper and stuck in place.

Accordingly, the reader will see that the unique, highly adaptable containment system of this invention can be used to provide requisite positioning and protection characteristics, while at the same time providing a recyclable, environmentally sound packaging solution. The invention provides a highly, desirable and efficient combination of application latitude and mechanical performance, even when used with heavy radiators. In addition to the aforementioned qualities, the component is cost effective and environmentally friendly, thus a highly efficient, cost effective, and environmentally sensitive product is provided. Furthermore, the unique, highly adaptable containment system for packaging radiators of this invention has additional advantages in that it provides packaging components that can be easily printed with environmentally friendly inks in order to carry messages or advertisements; and it permits the ready engineering of "application specific" packaging component designs when desired, with enhanced material(s) selection.

Although the description above contains many particular specifications in the described environment, these should not be construed as limiting the scope of the invention, but as merely providing illustrations of some presently preferred embodiments of the invention. For example, the packaging component may use flat laminated fiber board rather than the AB Kraft depicted; the packaging component may possess additional scores or cuts so as to facilitate folding or deliberate collapsing of the engineered component; other material might be laminated to additional materials such as corrugated paper or foam sheets in order to provide additional protection; various weights of components may be used; there are various possibilities with regard to the relative disposition of component orientation, etc.

Thus the scope of the invention should be determined by the appended claims and their physical and legal equivalents, rather than by the examples given herein.

What is claimed is:

1. A combination of a packaging system and a vehicle radiator assembled for transport to a remote location, comprising:

a base member having a central part defining a plane and a first pair of opposed sides, with a portion of each of said first pair of opposed sides being folded out of said plane and forming a pair of arms to said base member, a second pair of opposed sides on said base member, said second pair of opposed sides being orthogonal to said first pair of opposed sides, with a portion of each of said second pair of opposed sides being folded out of said plane of said base member in a direction opposite of said first pair of opposed sides, and forming legs to said base member;

a vehicle radiator positioned on said central part with said pair of arms in a folded condition over said vehicle radiator, said vehicle radiator including a non-fragile portion;

a stand-off element mounted to said non-fragile portion of said vehicle radiator, a strap engaged over said pair of arms to hold said pair of arms in said folded condition and stabilize said vehicle radiator relative to said base member; and a container, with said base member, said vehicle radiator, said stand-off element and said strap being in an assembled condition and positioned in said assembled condition within said container, with said stand-off element spacing said vehicle radiator from a first inside surface of said container and said legs spacing said vehicle radiator from a second inside surface of said container, said first inside surface being opposite said second inside surface.

2. The combination of claim 1 wherein said base member is made of a rectangular rigid planar sheet and wherein said pair of arms and said legs are defined at least in part by fold lines on said rectangular rigid planar sheet.

3. The combination of claim 2 wherein said rectangular rigid planar sheet has parallel lateral sides and parallel ends, and each of said legs are defined by a first fold line inboard from and parallel to an adjacent side of said first pair of opposed sides, and a second fold line inboard from and parallel to an adjacent side of said second pair of opposed sides.

4. The combination of claim 3 wherein each of said legs are further defined by a diagonal fold line extending diagonally inboard from each of a respective corner of said rectangular rigid planar sheet, each said diagonal fold line defining a gusset of each of said legs.

5. The combination of claim 3 wherein each of said legs are further defined by side leg portions and end leg portions, with a cut forming a lapping portion to one of said side leg portions and said end leg portions at each of a corner of said rectangular planar sheet, each said lapping portion being folded over and overlying an adjacent leg portion of each of said legs.

6. The combination of claim 5 further including pre-cut locking tabs formed in one of said side leg portions and said end leg portions at each corner of said rectangular planar sheet, and pre-cut tab receptacles formed in the other of said side leg portions and said end leg portions at each corner of said rectangular planar sheet, said pre-cut tabs being located within said pre-cut tab receptacles.

7. The combination of claim 2 wherein each of said pair of arms is defined by a pair of spaced cuts extending inboard from a respective side with a plurality of fold lines extending between said pair of spaced cuts.

* * * * *